US010808184B1

(12) United States Patent
Moore

(10) Patent No.: US 10,808,184 B1
(45) Date of Patent: Oct. 20, 2020

(54) CATALYTIC STRIPPING PROCESS

(71) Applicant: Marathon Petroleum Company LP, Findlay, OH (US)

(72) Inventor: Howard F. Moore, Ashland, KY (US)

(73) Assignee: Marathon Petroleum Company LP, Findlay, OH (US)

( * ) Notice: Subject to any disclaimer, the term of this patent is extended or adjusted under 35 U.S.C. 154(b) by 65 days.

(21) Appl. No.: 15/797,625

(22) Filed: Oct. 30, 2017

Related U.S. Application Data

(60) Provisional application No. 62/416,798, filed on Nov. 3, 2016.

(51) Int. Cl.
*C10G 67/02* (2006.01)
*C10G 75/00* (2006.01)

(52) U.S. Cl.
CPC ..... *C10G 67/02* (2013.01); *C10G 75/00* (2013.01); *C10G 2300/201* (2013.01)

(58) Field of Classification Search
CPC ... C10G 67/02; C10G 75/00; C10G 2300/201
See application file for complete search history.

(56) References Cited

U.S. PATENT DOCUMENTS

| | | | | |
|---|---|---|---|---|
| 3,719,027 | A * | 3/1973 | Salka | C07C 7/00 95/258 |
| 3,775,294 | A | 11/1973 | Peterson | |
| 3,839,484 | A | 10/1974 | Zimmerman, Jr. | |
| 4,849,182 | A | 7/1989 | Luetzelschwab | |
| 5,112,357 | A | 5/1992 | Bjerklund | |
| 6,169,218 | B1 | 1/2001 | Hearn | |
| 6,315,815 | B1 | 11/2001 | Spadaccini | |
| 7,459,081 | B2 | 12/2008 | Koenig | |
| 7,993,514 | B2 * | 8/2011 | Schlueter | C10G 3/45 208/255 |
| 8,354,065 | B1 | 1/2013 | Sexton | |
| 8,388,830 | B2 | 3/2013 | Sohn | |
| 8,609,048 | B1 | 12/2013 | Beadle | |
| 8,753,502 | B1 | 6/2014 | Sexton | |
| 8,764,970 | B1 | 7/2014 | Moore | |
| 2013/0225897 | A1 | 8/2013 | Candelon | |
| 2017/0226434 | A1 * | 8/2017 | Zimmerman | C10G 67/02 |

* cited by examiner

*Primary Examiner* — Randy Boyer
*Assistant Examiner* — Juan C Valencia
(74) *Attorney, Agent, or Firm* — Womble Bond Dickinson (US) LLP

(57) ABSTRACT

This development proposed adding a catalyst to an oxygen stripper. The oxygen stripper would be run at a temperature just below or at coking temp. The oxygen stripper includes a catalyst containing Group VI or VII metals to remove free radicals. Most preferably, the catalyst is a nickel-molybdenum catalyst.

17 Claims, 1 Drawing Sheet

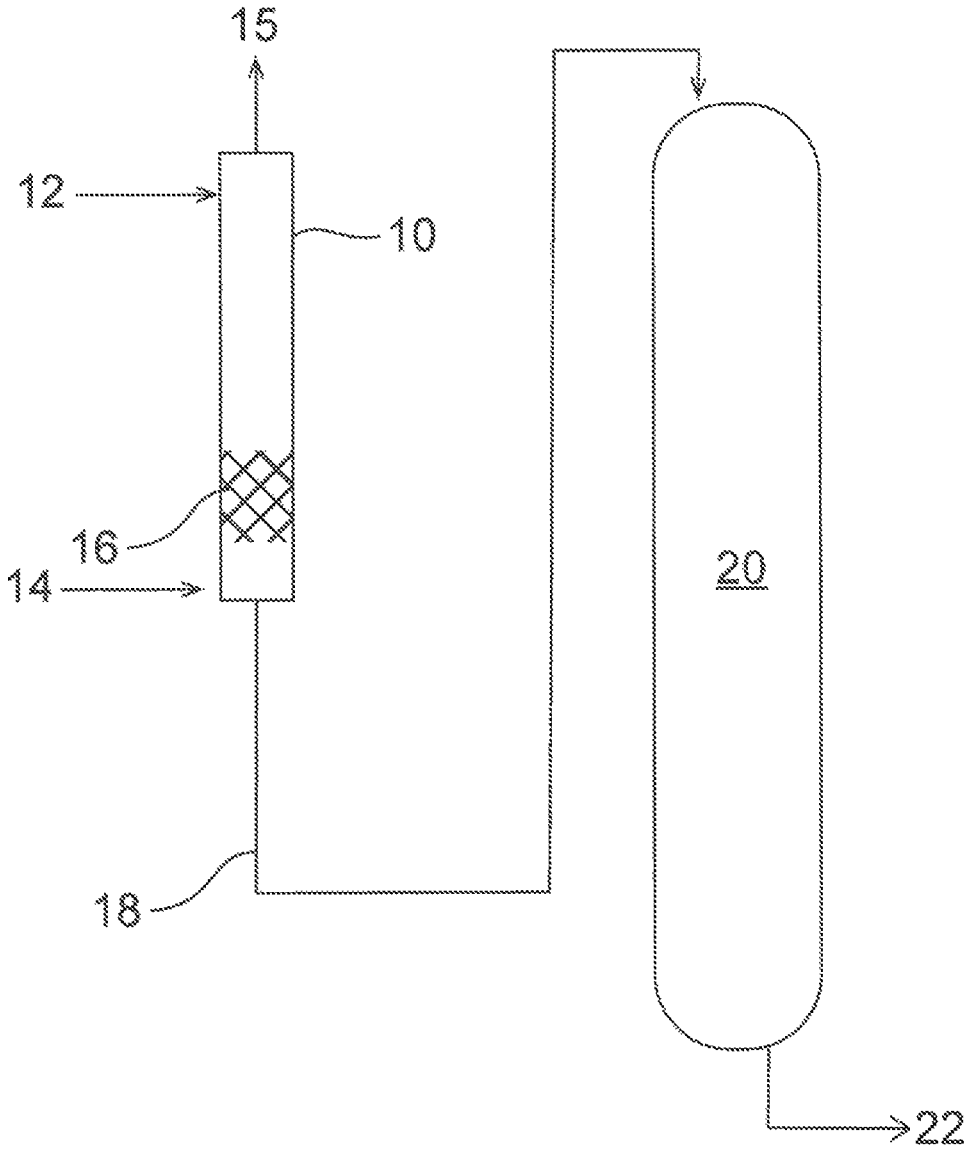
15
12
10
16
14
20
18
22

CATALYTIC STRIPPING PROCESS

CROSS REFERENCE TO RELATED APPLICATION

The present patent application is based upon and claims the benefit of provisional patent application No. 62/416,798, filed on Nov. 3, 2016.

TECHNICAL FIELD

This invention relates to stripping oxygen and free radicals from a hydrocarbon feed stream to reduce fouling tendencies. More specifically, the invention uses a catalyst to strip free radicals from the hydrocarbon feed stream.

BACKGROUND OF THE INVENTION

Refiners often purchase a significant amount of hydrocarbon feedstock from outside sources and/or store feedstocks in tanks with atmospheric contact. These feedstocks come in contact with oxygen during transport and storage. The contact with oxygen results in oxidative dehydrogenation and the formation of free radicals. The free radicals will polymerize when heated to 300° F. or more. It has been experienced that these free radicals and their polymerization result in aggressive fouling of the first exchanger in a hydrotreater. The excessive fouling in the first exchanger reduces the amount of heat produced for heating feedstock. This results in the need to run the heaters at a higher temperature than desirable and/or a reduction of production capacity.

The problems created by oxygen introduced hydrocarbon feedstock have been known for a long time. Some methods have been proposed to solve this problem. The first is the addition of another hydrotreater dedicated to run at mild conditions to eliminate the free radicals before their polymerization. However, this option has proven cost prohibitive and, having high energy consumption, has not been adopted by the industry.

Another well-known attempt to solve the problem of oxygenated feedstock, is the introduction of an oxygen stripper such as that shown in U.S. Pat. No. 8,388,830. Oxygen strippers are expensive but have been used in the industry for years. However, the oxygen strippers only remove unreacted oxygen. The oxygen that has already reacted to become free radicals is not removed. Other attempts to cure oxygenated feedstocks are exemplified by the apparatus and process shown in U.S. Pat. No. 7,993,514. The '514 patent teaches a stripper process and apparatus claiming to efficiently remove peroxides found in naphtha streams that are exposed to oxygen. However, as the '514 drawings show, the process requires a complex amount of apparatus including separators.

Therefore, there remains a desire for an inexpensive alternative method wherein both oxygen and free radicals are removed from oxygenated feedstock.

Another, the goal is to kill or remove free radicals before they polymerize.

And, yet another object of this invention is to remove oxygen and free radicals from a naphtha stream to maintain clean heat exchangers.

SUMMARY OF THE INVENTION

This invention proposes the addition of a small amount of hydrogenation catalyst to a new or an existing oxygen stripper. The oxygen stripper would be run at or just below polymerization temperature.

The oxygen stripper catalyst reacts with, and removes the free radicals from the hydrocarbon feedstock by hydrogenation, resulting in a substantial decrease in fouling. Specifically, an untreated oxidized Light Cycle Oil (LCO) feed was found to display a fouling rate of 6.5 mm Hg/min, with an onset time of 10 minutes. After passing the oxidized feed over a hydrogenation catalyst, the fouling rate dropped to 1.3 to 2.55 mm Hg/min, with an onset time of 4-10 minutes.

The apparatus for treating a hydrocarbon feedstock containing oxygen and free radicals comprises an oxygen stripper wherein the oxygen stripper includes a hydrogenation catalyst containing Group VI or VII metals.

Other objects and advantages of the present invention will become apparent to those skilled in the art upon a review of the following detailed description of the preferred embodiments and the accompanying drawings.

BRIEF DESCRIPTION OF THE DRAWINGS

FIG. 1 is a schematic representation of one configuration of the apparatus according to this invention. A more common configuration is expected to compose of the stripper feeding a hydrotreating process directly without intermediate separation.

DETAILED DESCRIPTION OF THE INVENTION

This invention adds a small amount of hydrogenation catalyst to an oxygen stripper. Either structured packing is used with a catalyst support or pelleted catalyst may be used, depending on the bed design. The hydrogenation catalyst can be provided in any form, such as extrudates, pellets, raschig rings and structured packing, as well as other commercially available types. It has been discovered that use of small amounts of hydrogenation catalyst is sufficient to remove enough oxygen from the hydrocarbon feed stream to keep the heat exchanger of the hydrotreaters clean and unfouled by polymerized free radicals.

Feedstock, when received and/or just before feeding to a hydrotreater will be counter currently contacted with hot hydrogen (350° F. or less). The hydrogen contained in the catalyst contact strips oxygen from the feedstock, stopping further damage to the hydrotreater. The catalyst reacts the hydrogen with the free radicals to cap them and render them unreactive. Temperatures are kept low enough to use minimum energy, while only reacting with the most reactive free radical component of the feedstock. The operating temperatures are preferably less than 350° F.

Referring now to FIG. 1, an oxygenated feedstock 12 is fed into a stripper unit 10 at a location proximate the top of the stripper unit 10. The feedstock flows downward through the stripper unit 10. Hot hydrogen gas 14 (generally 350° F. or less) is fed into the stripper unit 10, below the feedstock 12 entrance. The hydrogen gas 14 rises through the stripper unit 10, counter-currently to the flow of the feedstock 12. The hot hydrogen 14 contact strips oxygen from the feedstock 12 to create free radicals. The hydrogen gas carries the free radicals through the catalyst 16 to cap the free radicals and render them unreactive. The hydrogen gas exits the stripper 10 through exit 15. The deoxygenated feedstock 18 flows directly to a hydrotreating unit 20. As an alternative, the deoxygenated feedstock is sent directly to a reactor for fractionation. After processing, the hydrotreated products exit unit 20 via line 22.

Catalyst 16 typically is, preferably, a catalyst containing Group VI or VII metals, such as platinum, molybdenum, tungsten, nickel or cobalt. More preferably, the catalyst is a nickel-molybdenum or cobalt-molybdenum catalyst. Catalyst 16 may require a catalyst support, such as a structured packing. The structured packing, preferably, is open mesh knitted stainless steel wire or a pelleted catalyst.

The hydrocarbon feed stream 12 may vary widely. Typically, the stream 12 is a naphtha, kerosene, or diesel stream or components thereof such as a light cycle oil (LCO).

Example 1

Oxygenated LCO is transported to and unloaded to a tank. This LCO may be processed by this invention prior to unloading to the tank and/or when routed to the LCO hydrotreater. The LCO is introduced to or near the top tray of a stripping column, and trickles down the stripper to the bottom where it is collected and pumped to either a storage tank or the hydrotreater. Hydrogen at 300° F. is introduced to the bottom of the stripper through a distribution device, just below a section of hydrotreating catalyst in sufficient quantity to saturate all or most of the free radicals in the LCO, rendering it polymerization free and/or significantly reduced with no oxygen to cause further damage. Hydrogen travels countercurrent to the oil up the column, heating the oil and stripping residual oxygen from the LCO.

Example 2

Naphtha is transported by pipeline, picking up oxygen in breakout tanks as it travels. The naphtha is processed by this invention prior to being fed to the hydrotreater. The catalyst is applied to the bottom tray of the oxygen stripper. A steam heater is applied to heat the hydrogen to an estimated 250° F. Countercurrent stripping is used per the invention in capping of free radicals and significantly reducing fouling of the preheat exchangers of the hydrotreaters.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. A process for stripping oxygen and saturating free radicals contained in a diesel stream comprising:

passing the diesel stream to a reactor containing a catalyst comprised of groups VI or VII metals;

passing a hydrogen gas stream containing hydrogen gas into the reactor to create a countercurrent flow with the diesel stream;

contacting a portion of the hydrogen gas with the diesel stream, the oxygen being stripped by the portion of the hydrogen gas;

reacting another portion of the hydrogen gas with the free radicals via the catalyst, the free radicals being saturated thereby and rendered unreactive; and removing the stripped oxygen and hydrogen gas stream from the reactor.

2. A process according to claim 1 wherein the catalyst includes nickel-molybdenum.

3. A process according to claim 1 wherein the catalyst includes cobalt molybdenum.

4. A process according to claim 1 wherein the diesel stream is a high sulfur diesel.

5. A process according to claim 1 wherein the diesel stream is a low sulfur diesel.

6. A process according to claim 1 wherein the diesel stream is an ultra low sulfur diesel.

7. A process according to claim 1 wherein the catalyst includes palladium.

8. A process according to claim 1 wherein the catalyst includes any combination of nickel, cobalt, and molybdenum.

9. A process according to claim 1 wherein the catalyst includes platinum.

10. A process according to claim 1, further comprising:

removing the diesel stream from the reactor after the diesel stream is deoxygenated and its free radicals are rendered unreactive, and passing the diesel stream removed from the reactor to a hydrotreating unit.

11. A process according to claim 1, further comprising:

removing the diesel stream from the reactor after the diesel stream is deoxygenated and its free radicals are rendered unreactive, passing the diesel stream removed from the reactor through a heat exchanger and passing the diesel stream from the heat exchanger to a hydrotreating unit.

12. A process according to claim 1 further comprising:

heating the hydrogen gas stream prior to passing into the reactor to a temperature above that of the diesel stream.

13. A process according to claim 12 wherein the contacting the portion of the hydrogen gas with the diesel stream increases the temperature of the diesel stream.

14. A process according to claim 1 wherein the contacting the portion of the hydrogen gas with the diesel stream increases the temperature of the diesel stream.

15. A process according to claim 1 wherein the contacting the portion of the hydrogen gas with the diesel stream occurs prior to the reacting another portion of the hydrogen gas with the free radicals via the catalyst.

16. A process for stripping oxygen and saturating free radicals contained in an ultra-low sulfur diesel stream comprising:

passing the ultra-low sulfur diesel stream to a reactor containing a catalyst comprised of groups VI or VII metals;

passing a hydrogen gas stream containing hydrogen gas into the reactor to create a countercurrent flow with the ultra-low sulfur diesel stream;

contacting a portion of the hydrogen gas with the ultra-low sulfur diesel stream, the oxygen being stripped by the portion of the hydrogen gas;

reacting another portion of the hydrogen gas with the free radicals via the catalyst, the free radicals being saturated thereby and rendered unreactive; and removing the stripped oxygen and hydrogen gas stream from the reactor.

17. A process for stripping oxygen and saturating free radicals contained in a diesel stream that includes diesel with a sulfur content in excess of an ultra-low sulfur diesel content, the process comprising:

passing the diesel stream to a reactor containing a catalyst comprised of groups VI or VII metals;

passing a hydrogen gas stream containing hydrogen gas into the reactor to create a countercurrent flow with the diesel stream;

contacting a portion of the hydrogen gas with the diesel stream, the oxygen being stripped by the portion of the hydrogen gas;

reacting another portion of the hydrogen gas with the free radicals via the catalyst, the free radicals being saturated thereby and rendered unreactive; and removing the stripped oxygen and hydrogen gas stream from the reactor.

* * * * *